US005287873A

United States Patent [19]

Venet

[11] Patent Number: 5,287,873

[45] Date of Patent: Feb. 22, 1994

[54] INSTALLATION AND PROCESS FOR THE DISTRIBUTION OF VERY HIGH PURITY NITROGEN

[75] Inventor: Francois Venet, Walnut Creek, Calif.

[73] Assignee: L'Air Liquide, Societe Anonyme Pour L'Etude et L'Exploitation des Procedes Georges Claude, Paris, France

[21] Appl. No.: 976,102

[22] Filed: Nov. 13, 1992

[30] Foreign Application Priority Data

Nov. 14, 1991 [FR] France ..... 91 14004

[51] Int. Cl.[5] ..... F17D 1/04

[52] U.S. Cl. ..... 137/1; 137/561 R; 137/209

[58] Field of Search ..... 137/561 R, 209, 1

[56] References Cited

U.S. PATENT DOCUMENTS 4,859,375 8/1989 Lipisko et al. ..... 137/209 X 5,148,945 9/1992 Gaetz ..... 137/209 X

FOREIGN PATENT DOCUMENTS 0413835 2/1991 European Pat. Off. .

2527645 12/1983 France .

*Primary Examiner*—John Rivell

*Attorney, Agent, or Firm*—Young & Thompson

[57] ABSTRACT

The conduits (1–4) of length L have a linear section $S_1$ and contain a volumetric flow rate of nitrogen Q such that, to obtain a molar concentration of impurities upon out-gassing less than $C_{max}$, $Q/S_1$ is not less than $9.5\times10^{-9}$ $L/C_{max}$. The conduits are of stainless steel with a low carbon content, not electropolished and/or chemically treated. The joints (6, 7, 9, 11) between the conduits and/or the active members (5) are maintained externally in a neutral protective atmosphere confined in a sealed casing (8, 9 . . . ) Application particularly to electronic industries.

14 Claims, 1 Drawing Sheet

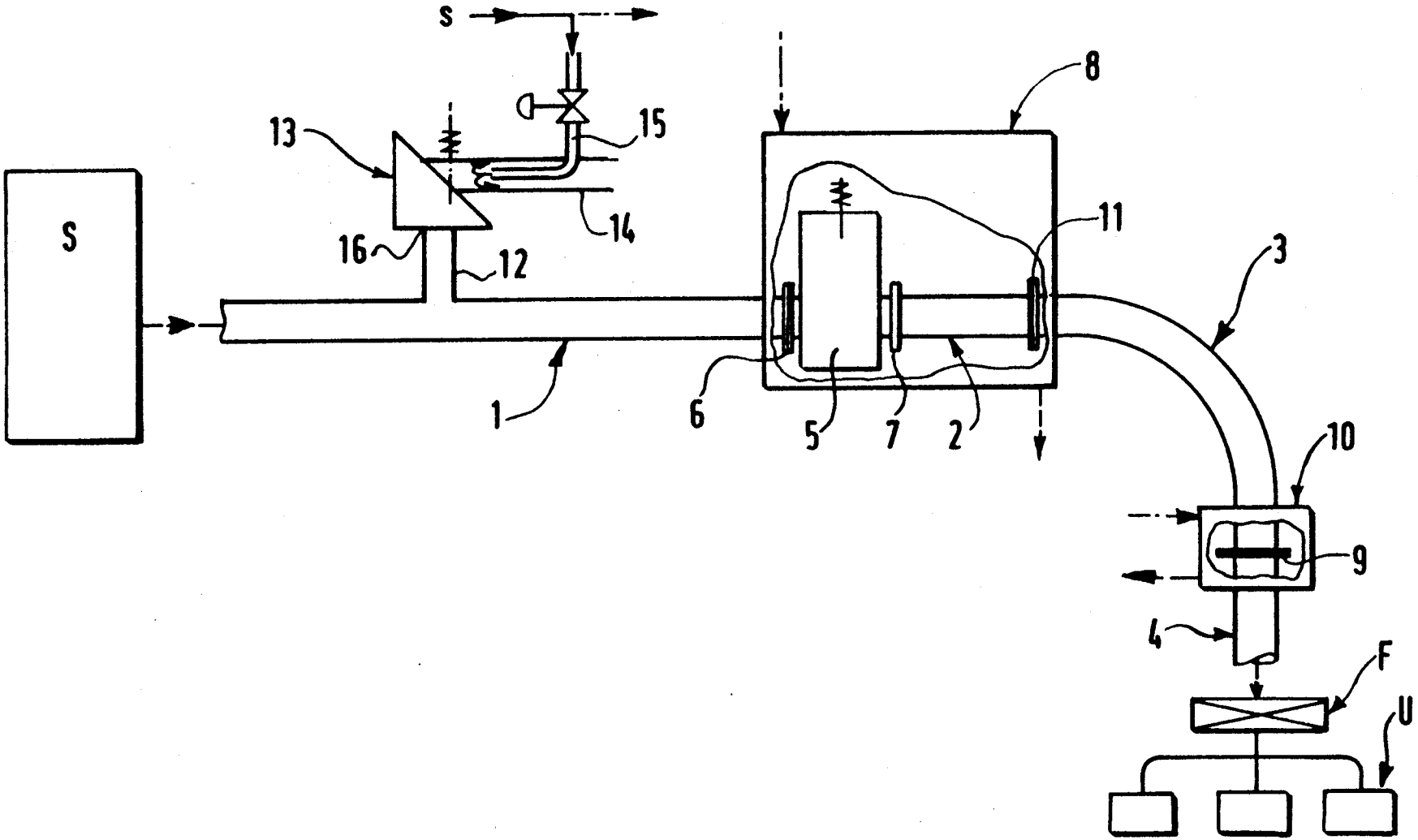
U
F
10
9
3
4
8
11
2
7
5
6
15
14
12
1
S
16
13
S

INSTALLATION AND PROCESS FOR THE DISTRIBUTION OF VERY HIGH PURITY NITROGEN

FIELD OF THE INVENTION

The present invention relates to installations for the distribution of very high purity nitrogen, particularly for the electronic industry, comprising at least one series of conduits and active members.

By "nitrogen of very high purity" is meant nitrogen containing traces of impurities, principally water, hydrogen and oxygen, less than 100 ppb. By "active members" is meant the different types of valves or check valves permitting establishing and controlling the distribution of the gas in the installation.

BACKGROUND OF THE INVENTION

The very high degrees of purity required for the production of integrated circuits of very high density require limiting to the minimum the risks of contamination in the installations for the distribution of gas supplying these installations and products, at the source, with very high purity. In the distribution installation, there are essentially three sources of contamination resulting from problems of losses or retro-diffusion (principally for water vapor and oxygen), of out-gassing from the elements of the installation itself (essentially for water and hydrogen) and dead spaces. The first approach to limit these risks of contamination has consisted in using extremely carefully made conduits that have been subjected to particular internal treatments, essentially an electropolishing or a chemical treatment, and special active members such as bellows valves, diaphragm valves, valves comprising special arrangements, and assemblies without flanges. This special equipment is extremely troublesome, complicating the production of the installation, and certain elements of the special components, particularly the bellows, constitute additional traps for humidity and impurities.

SUMMARY OF THE INVENTION

The present invention has for its object to provide an installation for the distribution of nitrogen at very high purity permitting, at low investment and operating costs, limiting greatly the sources of contamination.

To do this, according to a characteristic of the invention, the installation comprises portions of conduits of a total length L (in meters) and having a linear section $S_1$ (in $m^2/m$) and in which the flow rate of nitrogen Q (in $Nm^3/h$) necessary to obtain a molar concentration C of out-gassing impurities less than $C_{max}$ (in mole/mole) is such that $Q/S_1$ is not less than $9.5\times10^{-9}$ $L/C_{max}$, which are produced from stainless steel with a carbon content less than 0.05%, and are not electropolished nor internally chemically treated, said conduit portions having typically an internal diameter not less than 51 mm (2"). The permissible molar concentration $C_{max}$ is typically chosen as a tenth of the maximum content of impurities guaranteed by the specifications.

The applicant has thus determined that under the conditions mentioned above, corresponding to relatively great diameters and flow rates involving essentially the upstream circuits of the distribution installation, before the filters, relatively conventional conduits would give rise to levels (less than 1 ppb of water) of contamination due to out-gassing not greater than the sophisticated conduits used at present.

According to another characteristic of the invention, at least certain conduits of the installation are assembled with each other and/or with active members by joints maintained externally in a neutral protective atmosphere, at least certain active members being preferably also maintained externally in a neutral protective atmosphere typically contained in a sealed pressurized housing enclosing the joint and/or the active member, the neutral protective atmosphere being preferably constituted by nitrogen of industrial purity, which is to say that it can contain up to 1000 ppm of impurities.

The applicant has discovered that with such measures it was possible to omit the classical complicated joints as well as the special active members habitually used when having recourse to conventional joints of the flange type, and to conventional industrial components, the maintenance of these latter under a neutral protective atmosphere, even of purity inferior to that of the transported gas, permitting eliminating almost all the risks of contamination by loss or retro-diffusion.

According to another characteristic of the invention, for using such an installation, at the outset the latter is swept with a current of nitrogen in turbulent flow (Reynolds number greater than 2000), which permits purging effectively the dead spaces.

BRIEF DESCRIPTION OF THE DRAWINGS

Other characteristics and advantages of the present invention will appear from the following description of an embodiment, given by way of non-limiting illustration, with reference to the accompanying drawing, in which:

The single FIGURE shows schematically a distribution conduit for ultra-pure oxygen in which are shown the principal characteristics of the invention.

DETAILED DESCRIPTION OF THE INVENTION

There is shown on this figure a branch of an installation for the distribution of oxygen from a source of oxygen of very high purity S, typically a cryogenic unit for the separation of gas from air, to utilization stations U, via filters F. The branch comprises a series of tubular portions 1, 2, 3, 4. If the volumetric flow Q ($Nm^3/h$) of nitrogen in the tubing and the linear section $S_1$ ($m^2/m$) of the portions of this latter have a ratio greater than 3000, typically 3200, the portions 1 to 4 are of stainless steel of low carbon content (less than 0.05%), containing more than 15% chromium and more than 8% nickel, having been subjected to hyperquenching, for example the grades TP 304 L or TP 316 L, without requiring internal treatment operations, such as electropolishing or oxygen passivation. Under these circumstances, for a flow rate Q of 1000 $Nm^3/h$, at a pressure of 800 kPa absolute and ambient temperature, the level of impurities in a conduit of 0.10 m (4") of internal diameter and of 100 m of length are less than 30 ppt.

Between the portions 1 and 2 is interposed an active member, for example a regulation valve 5. According to one aspect of the invention, the regulation valve 5 is of commercial type, not specific to use under high purity, and the joint between the tubes 1 and 2 and the valve 5 is effected by conventional flanges 6 and 7, the assembly of the valve 5 and the flanges 6 and 7 being disposed in a sealed casing 8 containing commercial nitrogen under a slight superatmospheric pressure, the nitrogen being adapted to be commercial nitrogen, which is to say containing up to 100 ppm of various impurities, particularly oxygen.

In like manner, the joint between the sections 3 and 4 is effected by flanges 9, the joint being enclosed in a sealed casing 10 containing commercial nitrogen. In the embodiment shown, the flanged joint 11 between the sections 2 and 3 is also placed under a neutral protective atmosphere, for example in the casing 8. For increased security, there will preferably be provided a Teflon or metallic joint, type RX/BX between the joint flanges.

The section 3 is an elbowed section and, according to one aspect of the invention, to avoid the formation of irregularities on the internal surface of this section, the radius of curvature of the elbow is not less than ten times the internal diameter of the section 3.

The section 1 comprises a welded branch 12 to a purge valve 13 comprising an outlet conduit 14 for the purge gas. According to one aspect of the invention, into the tubing 14 there empties, countercurrent, adjacent the outlet of the flap of valves 13, a conduit 15 connected to a source s of commercial nitrogen emptying into the tubing 14 a flow rate of commercial nitrogen of the order of 0.1 m/second to prevent any reentry of environmental atmosphere into the valve 13. In the illustrated example, this latter not being enclosed in a protective housing, it is connected to the branch 12 by welding 16. The source s of commercial nitrogen, which can also be drawn from the unit S, serves advantageously for the creation and maintenance of the housings 8 and 10 under a protective atmosphere.

Numerous regions of a distribution conduit have local dead zones, such as the branch 12, which includes potential traps for impurities. According to one aspect of the invention, during the start-up of the installation, the conduits are purged by a turbulent flow (Reynolds number greater than 2000) of nitrogen which is not necessarily ultra-pure, followed by the normal purge at start-up with ultra-pure nitrogen before the installation goes onstream.

Although the present invention has been described in relation to particular embodiments, it is not thereby limited but is on the contrary susceptible to modifications and variations which will become apparent to persons skilled in the art.

What is claimed is:

1. Installation for the distribution of a very high purity nitrogen, comprising at least one series of delivery conduits and active members, wherein the delivery conduits include conduit portions having a length L, a linear section $S_1$ and undergoing a volumetric flow Q of delivered nitrogen such as, in order to obtain a molar concentration of out-gassing impurities less than $C_{max}$, $Q/S_1$ is not less than $9.5\times10^{-9}$ $L/C_{max}$, said conduit portions being made of stainless steel having a carbon content less than 0.05% and being free from electro-polishing and internal chemical treatment.

2. Installation according to claim 1, wherein the conduit portions have an internal diameter not less than 51 mm.

3. Installation according to claim 1, wherein at least some of the conduit portions are assembled with each other or with active members by joining means which are maintained externally in a neutral protective atmosphere.

4. Installation according to claim 1, wherein at least certain of the active members are maintained externally in a neutral protective atmosphere.

5. Installation according to claim 3, wherein the neutral protective atmosphere is contained in a sealed casing enclosing the joining means.

6. Installation according to claim 4, wherein the neutral protective atmosphere is contained in a sealed casing enclosing the active member.

7. Installation according to claim 3, wherein the neutral protective atmosphere is constituted by nitrogen of industrial purity.

8. Installation according to claim 4, wherein the neutral protective atmosphere is constituted by nitrogen of industrial purity.

9. Installation according to claim 3, wherein at least certain of the joining means are flanged joints.

10. Installation according to claim 9, wherein at least certain of the flanged joints comprise a Teflon or metal joint.

11. Installation according to claim 1, comprising at least one active member of the purge valve type comprising a purge conduit, and a sweeping circuit for sweeping the purge conduit with nitrogen of industrial purity.

12. Installation according to claim 11, wherein the sweeping flow rate of nitrogen is about 0.1 m/second.

13. Installation according to claim 1, comprising at least one elbowed tubular portion, wherein the radius of curvature of the elbow is greater than ten times the internal diameter of the elbowed tubular portion.

14. Process for the distribution of a very high purity nitrogen, which comprises: providing an installation having at least one series of delivery conduits and active members, wherein the delivery conduits include conduit portions having a length L, a linear section $S_1$ and undergoing a volumetric flow Q of delivered nitrogen such as, in order to obtain a molar concentration of out-gassing impurities less than $C_{max}$, $Q/S_1$ is not less than $9.5\times10^{-9}$ $L/C_{max}$, said conduit portions being made of stainless steel having a carbon content less than 0.05% and being free from electro-polishing and internal chemical treatment, and purging said installation with a current of nitrogen under turbulent flow at the time of start-up.

* * * * *